US005199266A

United States Patent [19]

Johansen

[11] Patent Number: 5,199,266

[45] Date of Patent: Apr. 6, 1993

[54] UNPROCESSED PETROLEUM GAS TRANSPORT

[75] Inventor: Arne Johansen, Grimstad, Norway

[73] Assignee: Ugland Engineering A/S, Grimstad, Norway

[21] Appl. No.: 837,963

[22] Filed: Feb. 20, 1992

[30] Foreign Application Priority Data

Feb. 21, 1991 [GB] United Kingdom ..... 9103622

[51] Int. Cl.[5] ..... F25J 1/00; F17C 13/08

[52] U.S. Cl. ..... 62/8; 62/9; 62/53.2; 62/240

[58] Field of Search ..... 62/8, 9, 11, 36, 50.1, 62/53.2, 47.1, 240, 17, 24, 50.7

[56] References Cited

U.S. PATENT DOCUMENTS

| | | | |
|---|---|---|---|
| Re. 29,914 | 2/1979 | Perret | 62/9 |
| 3,365,898 | 1/1968 | Van Kleef | 62/240 X |
| 3,400,547 | 9/1968 | Williams et al. | 62/9 X |
| 3,535,885 | 10/1970 | Frijlink et al. | 62/9 |
| 3,663,644 | 5/1972 | Harvey | 62/8 X |
| 4,033,735 | 7/1977 | Swenson . | |
| 4,213,476 | 7/1980 | Bressie et al. | 62/50.7 |
| 4,251,247 | 2/1981 | Gauberthier et al. | 62/9 |
| 4,266,958 | 5/1981 | Cummings | 62/17 X |
| 4,285,709 | 8/1981 | Gram | 62/24 X |
| 4,303,427 | 12/1981 | Krieger | 62/9 |
| 4,315,408 | 2/1982 | Karl | 62/50.7 |
| 4,419,114 | 12/1983 | May et al. | 62/17 |
| 4,462,813 | 7/1984 | May et al. | 62/17 |
| 4,809,154 | 2/1989 | Newton | 62/9 X |
| 5,025,860 | 6/1991 | Mandrin | 62/48.2 X |

FOREIGN PATENT DOCUMENTS

| | | | |
|---|---|---|---|
| 0530808 | 10/1957 | Belgium | 62/53.2 |
| 0143267 | 5/1985 | European Pat. Off. . | |
| 1960301 | 12/1969 | Fed. Rep. of Germany . | |
| 1291467 | 11/1969 | United Kingdom . | |
| 1585167 | 9/1976 | United Kingdom . | |
| 2073393 | 3/1981 | United Kingdom . | |
| 2229519 | 3/1989 | United Kingdom . | |

*Primary Examiner*—Henry A. Bennet
*Assistant Examiner*—Christopher Kilner

[57] ABSTRACT

A method of dealing with unprocessed petroleum gas from an oil or gas production field, comprises separating liquids and solids from the unprocessed gas of the well stream, drying the unprocessed gas, cooling the unprocessed gas under pressure to produce liquefied petroleum gas at a temperature of not lower than −120° C., and placing the liquefied gas in storage tanks at a temperature between about −100° C. and −120° C. and a pressure of from 10 to 30 Bar, preferably from 14 to 18 Bar, for transportation, e.g. by shuttle tanker containing suitable storage tanks, to a remote processing and/or distribution station.

7 Claims, 4 Drawing Sheets

UNPROCESSED PETROLEUM GAS TRANSPORT

FIELD OF THE INVENTION

The invention relates to the transport of unprocessed petroleum gas from an oil or gas production field, especially an offshore production field.

BACKGROUND OF THE INVENTION

Unprocessed petroleum gas comprises a mixture of methane and heavier hydrocarbons such as ethane, propane, butane, etc, the actual composition varying according to the field from which it originates. For power stations and some industrial uses, unprocessed petroleum gas does not need processing, but for network distribution the gas is usually processed to bring its composition and calorific value within predetermined limits before supply to the distribution network.

Delivery of petroleum gas from an offshore field to a Processing station and/or distribution system onshore is not a problem for relatively large gas production fields for which it is economic to lay a delivery pipeline. For smaller fields and for the surplus gas obtained from oil production fields, however, it is not considered economic to provide for similar delivery of the gas, and the gas has so far not been used. In the case of oil field gas, it has been usual to burn off this gas at the production field, but in many areas such burning is now prohibited.

The present invention therefore aims to provide a method which will enable such gas to be delivered ashore in a sufficiently economic manner for it to be a practical proposition to make use of the gas. As an example, it has been estimated that, if it can be brought ashore economically, the surplus gas produced annually by the three oil fields in the Haltenbanken area of the Norwegian continental shelf, Njord, Draugen and Heidrun, would be sufficient to generate electricity equivalent to about 10% of the total electricity consumption of Norway in 1990.

SUMMARY OF THE INVENTION

According to the invention, there is provided a method of dealing with unprocessed petroleum gas from an oil or gas production field, comprising separating liquids and solids from the unprocessed gas of the well stream, drying the unprocessed gas, cooling and, if necessary, further compressing the unprocessed gas to produce liquefied unprocessed petroleum gas at a temperature of not lower than −120° C., and placing the liquefied unprocessed petroleum gas in storage tanks at a temperature between about −100° C. and −120° C. and a pressure of from 10 to 30 Bar, preferably from 14 to 18 Bar, for transportation to a remote processing and/or distribution station.

Preferably the unprocessed petroleum gas is liquefied at a pressure of from about 60 to 80 Bar.

By keeping the temperature of the liquefied gas above −120° C., the disadvantageous occurrence of solid phases in the storage tanks is prevented, even if the gas mixture contains a relatively large number of rather high carbon number petroleum gas components or even petroleum components which are liquid at ambient temperature and pressure. Furthermore, under the temperature and pressure conditions specified in the method in accordance with the invention, a wide range of petroleum gas compositions will be liquid without any solids content.

The liquefaction of natural gas for transportation is well known, but generally this involves cooling and liquefying the gas at a temperature of −163° C. for transportation at a pressure of about 1 Bar. However, liquefaction at such low temperatures is a relatively expensive process, and also involves pre- processing of the gas to remove carbon dioxide and other components which would form a solid phase at the liquefaction temperature.

In contrast, the cost of liquefaction of petroleum gas at a temperature in the region of about −110° C., for example using a mixed coolant refrigeration process (MCR) employing propane, ethane and methane as the working fluids, is much less, and although it is necessary to provide stronger storage/transport tanks in order to withstand the higher pressures, the method in accordance with the invention still presents a cost effective way of bulk-transporting unprocessed petroleum gas, especially from an offshore field.

In this case the tanks will be transported by ship, and since the tanks and the liquefaction equipment may be permanently installed on the ship, the method in accordance with the invention will involve virtually no additional plant or cost at the production field. Furthermore, the use of ships, even though requiring specially fitted equipment, provides the cheapest possible total transport chain for the gas.

Embodiments of the method in accordance with the invention will now be described, by way of example, with reference to the accompanying drawings.

DESCRIPTION OF THE PREFERRED EMBODIMENTS

Figure 1:
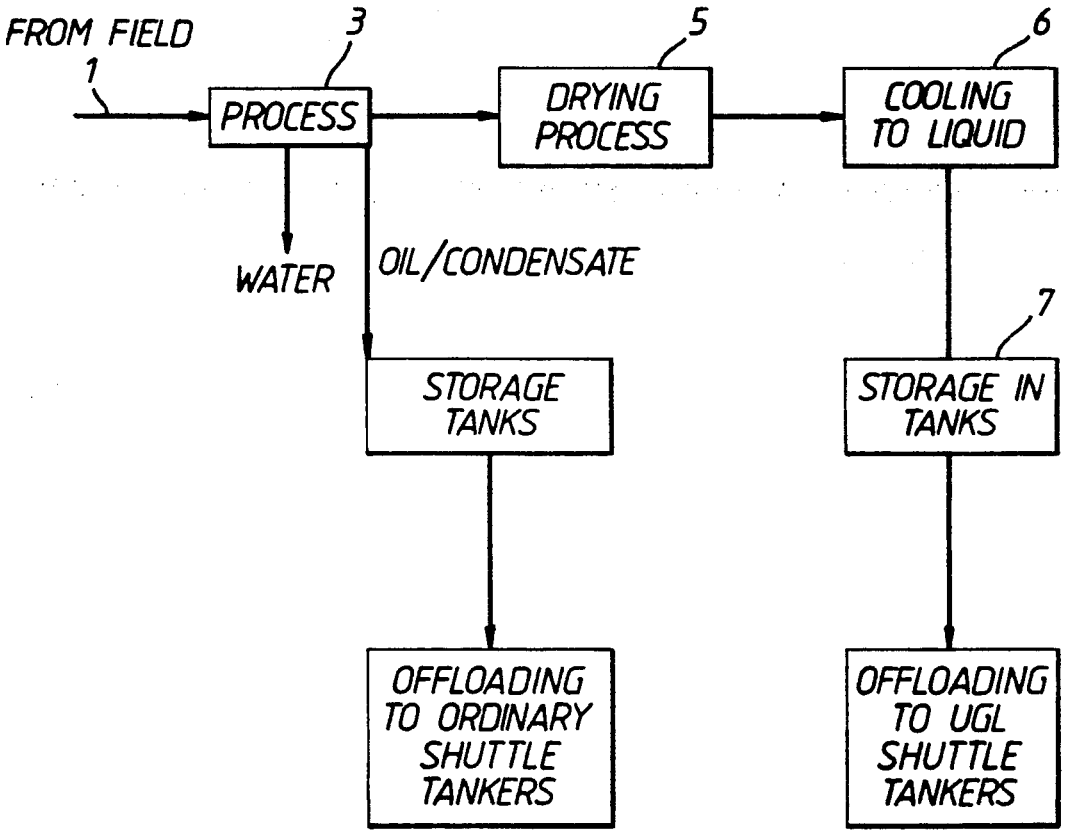
FIG. 1 is a block diagram representing an embodiment of the invention applied to the collection and transport of surplus gas obtained from an oil field production well.
Figure 2:
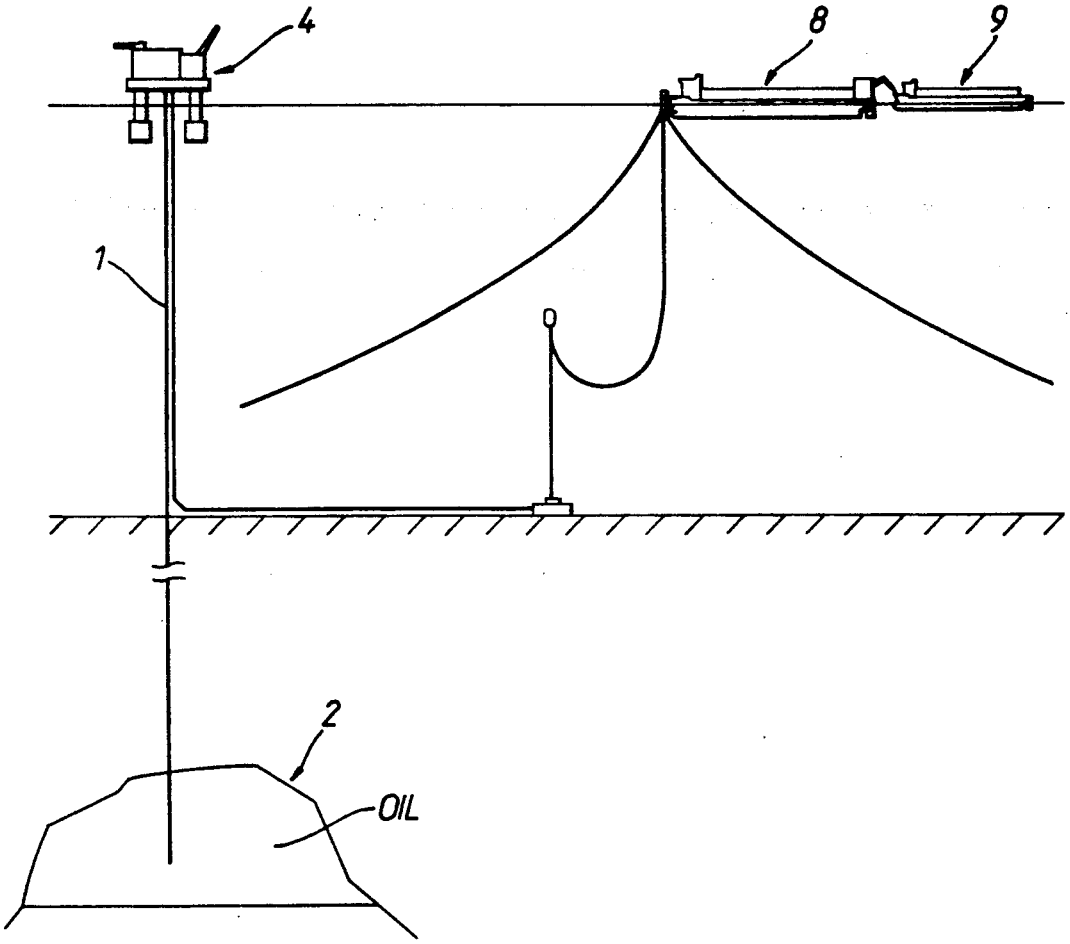
FIG. 2 is a diagram illustrating a practical application of the embodiment represented in FIG. 1 to an offshore oil well.

In the method illustrated in FIGS. 1 and 2 the well stream 1 from an oil field 2 is subjected to a separator stage 3 on the production rig 4 so that the oil, petroleum gas and the water of the well stream are separated from each other. The water is rejected, and the oil is processed by the rig 4 in the usual way. The unprocessed petroleum gas is then fully dried in a drying stage 5, which may be of any suitable known type, before being delivered at a temperature of about 20° C. and a pressure of about 70 Bar to a liquefaction stage 6 which reduces the unprocessed petroleum gas to a liquid state at a temperature of about −110° C. to −120° C. and a pressure of about 14 to 18 Bar. This liquefied unprocessed petroleum gas is then delivered to suitable storage tanks 7.

As shown in FIG. 2, in the case of an offshore oil field the drying stage 5, liquefaction stage 6 and storage tanks 7 may be carried by a vessel 8 moored in the vicinity of the rig 4 (which also could be a ship or a platform), and the liquefied gas may be transferred to suitable tanks of a shuttle tanker 9 for transport to a distant receiving port. The transfer of the unprocessed gas from the oil production rig 4 to the vessel 8 is by pipeline with the gas in the gas phase.

Figure 3:
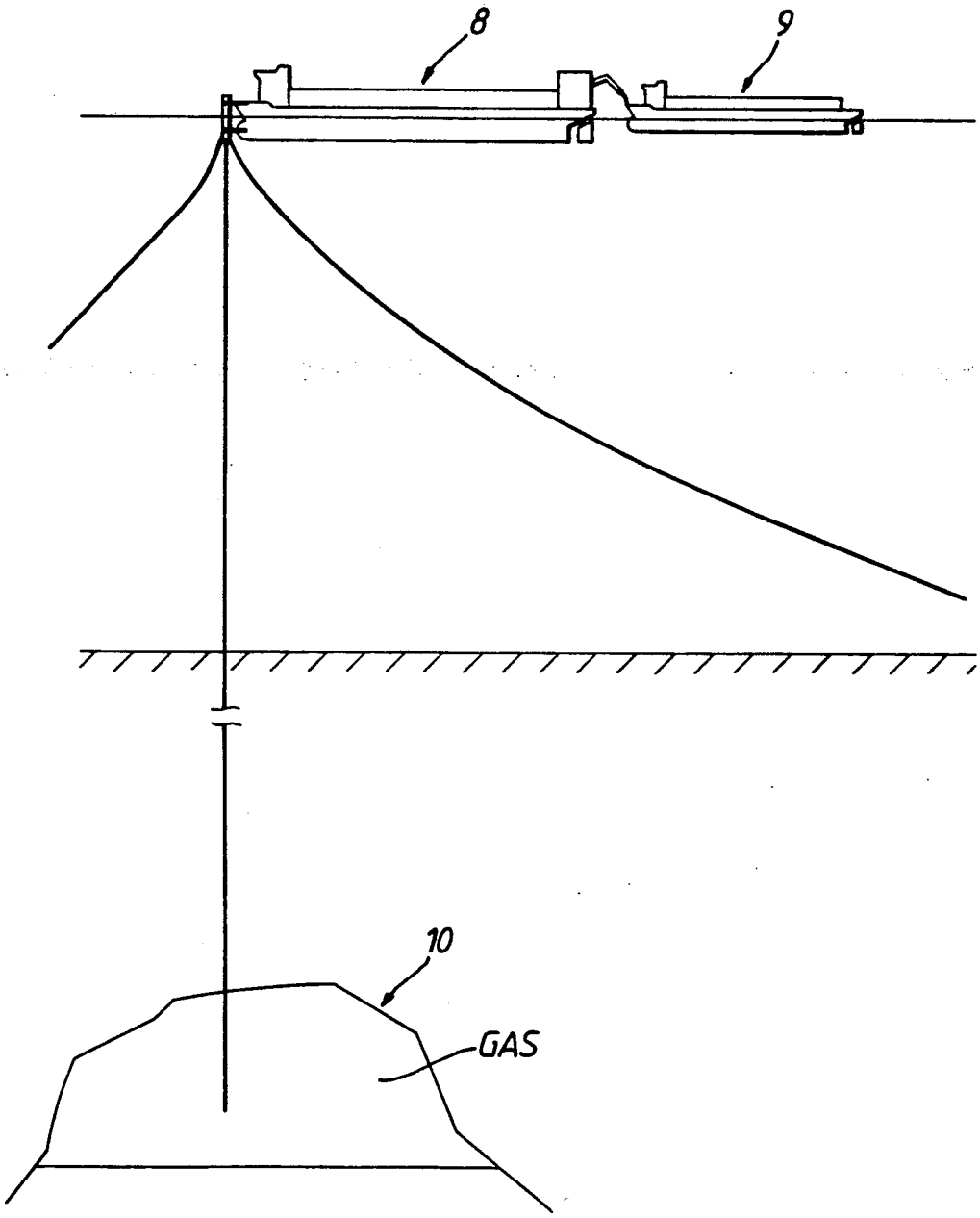
FIG. 3 is a diagram similar to FIG. 2 but illustrating the application of the invention to the collection and transport of petroleum gas from an offshore gas field.

As shown in FIG. 3, unprocessed petroleum gas from an offshore gas field 10 may be collected, dried and liquefied by a vessel 8 for transport by a shuttle tanker 9 in a manner similar to that described above with reference to FIGS. 1 and 2.

Figure 4:
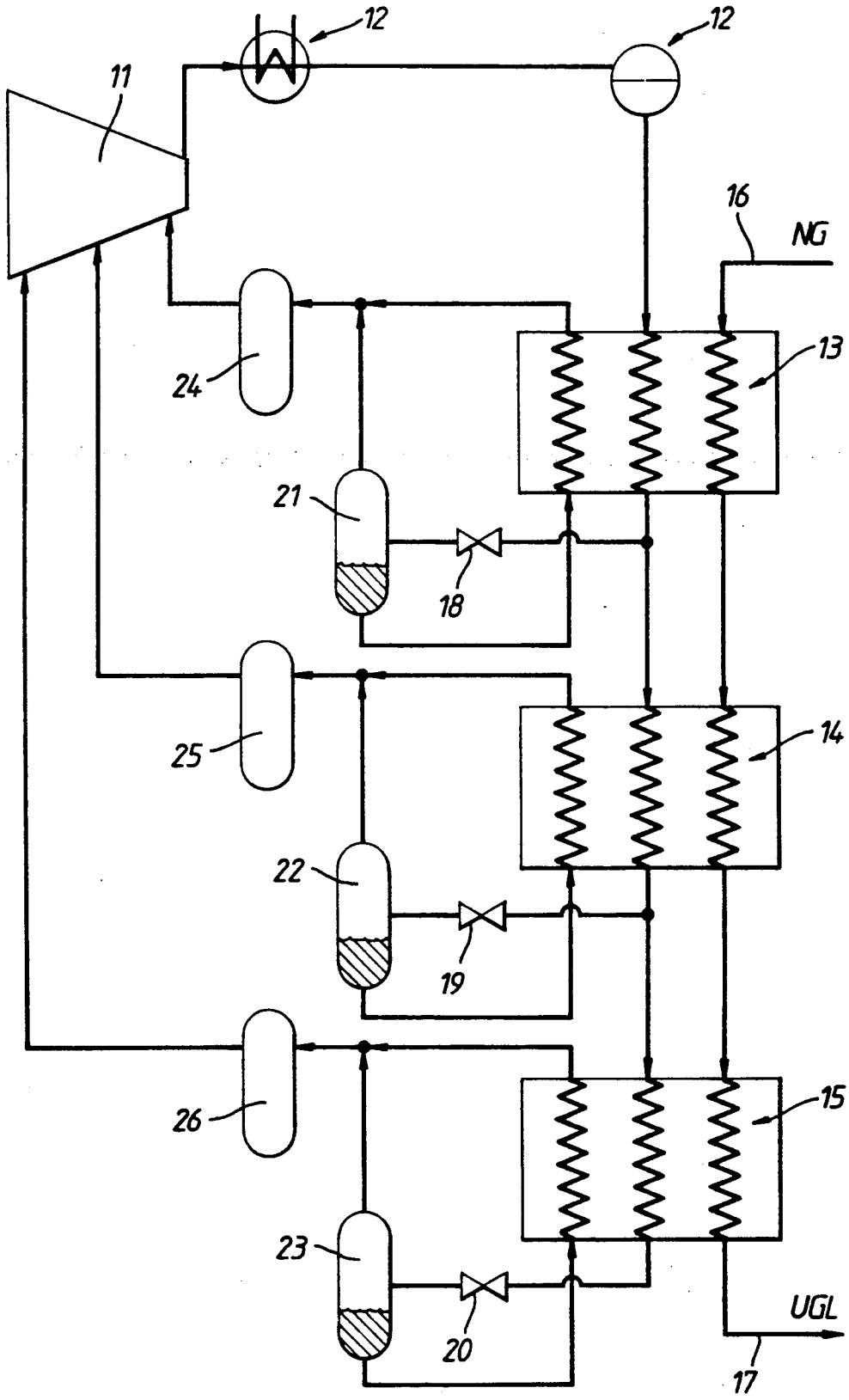
FIG. 4 is a diagram of a liquefaction stage which may be used in carrying out the method in accordance with the invention.

One form of liquefaction system which may be used for the liquefaction stage 6 is shown in FIG. 4. This system is essentially a mixed coolant refrigeration system (MCR) using a mixture of methane, ethane and propane as the coolant.

The system comprises a compressor 11, a condensor 12 in which heat from the compressed coolant is lost to the surroundings, e.g. by heat exchange with seawater, and a series of heat exchangers 13,14,15 (three in this example) forming coolant evaporator stages in which the unprocessed petroleum gas entering the system at 16 at about 70 Bar and 20° C. is progressively cooled and liquefied to about −110° C. to −120° C. at the outlet 17. This output liquefied petroleum gas is still at the inlet pressure of about 70 Bar and is then throttled to the storage/transport pressure of 14 to 18 Bar before being delivered to the storage tanks.

After each heat exchanger 13,14,15 the evaporated part of the coolant is expanded through a throttle 18,19,20 and the condensing portion thereof is collected by a separator 21,22,23 and fed back through the respective heat exchanger to assist the cooling of the unprocessed petroleum gas stream. This portion of the coolant is thus evaporated and is collected with the vapour portion from the separator 21,22,23 in a gas phase accumulator 24,25,26 for return to the compressor 11.

I claim:

1. A method of dealing with unprocessed petroleum gas obtained under pressure from a well stream of an oil or gas production field, comprising separating liquids and solids from said unprocessed gas drying said unprocessed gas, cooling said unprocessed gas under sufficient pressure to produce liquefied unprocessed petroleum gas al a temperature of not lower than −120° C., and placing said liquefied unprocessed petroleum gas in storage tanks at a temperature between about −100° C. and −120° C. and a pressure of from 10 to 30 Bar for transportation to a remote processing and/or distribution station.

2. A method according to claim 1, wherein said unprocessed petroleum gas is liquefied at a pressure of from about 60 to 80 Bar.

3. A method according to claim 1, wherein said liquefied unprocessed petroleum gas is placed in said storage tanks at a pressure of from 14 to 18 Bar.

4. A method according to claim 1, wherein said unprocessed petroleum gas is liquefied using a mixed coolant refrigeration process employing propane, ethane and methane as the working fluids.

5. A method according to claim 1, wherein said unprocessed gas is from an offshore oil or gas production field, and said storage tanks in which said liquefied unprocessed petroleum gas is placed are transported by ship to a distant receiving port.

6. A method according to claim 1, wherein said unprocessed gas is from an offshore oil or gas Production field, and said drying and liquefaction of said unprocessed petroleum gas is carried out on a vessel which is moored in the vicinity of the field production rig and which is provided with storage tanks for receiving said liquefied unprocessed petroleum gas.

7. A method according to claim 6, in which said liquefied unprocessed petroleum gas is transferred from the storage tanks of said vessel to storage tanks of a shuttle tanker for transport to a distant receiving port.

* * * * *